US006036262A

United States Patent [19]

Shahid

[11] Patent Number: 6,036,262

[45] Date of Patent: Mar. 14, 2000

[54] CARRY-ALL CHAIR

[76] Inventor: William Mark Shahid, P.O. Box 85, Destin, Fla. 32540-0085

[21] Appl. No.: 08/314,829

[22] Filed: Sep. 29, 1994

[51] Int. Cl.[7] ..... A47C 7/62; A47C 7/66

[52] U.S. Cl. ..... 297/188.04; 297/184.15; 297/188.14

[58] Field of Search ..... 297/188.06, 188.01, 297/188.04, 188.14, 184.15, 183.1, 228.1, 188.18

[56] References Cited

U.S. PATENT DOCUMENTS

| | | | |
|---|---|---|---|
| 4,072,345 | 2/1978 | Matsuda et al. | 297/184.15 |
| 4,201,416 | 5/1980 | Vanderminder | 297/184.15 |
| 5,013,085 | 5/1991 | Craig | 297/184.15 |
| 5,139,308 | 8/1992 | Zimar | 297/188.06 |
| 5,326,152 | 7/1994 | Baron | 297/228.1 |
| 5,350,215 | 9/1994 | DeMars | 297/188.14 |
| 5,356,107 | 10/1994 | Suohuiz | 297/188.18 |
| 5,395,157 | 3/1995 | Rollo et al. | 297/183.1 |

*Primary Examiner*—Anthony D. Barfield
*Attorney, Agent, or Firm*—Morris, Manning & Martin, L.L.P.

[57] ABSTRACT

A reclining beach chair having a foldable frame and a fabric stretched across this frame also incorporates an overhead canopy, made with ultra-violet beta tan-through materials, that can be adjusted as desired as well as a multitude of separate storage compartments secured both to the chair and also to its arm rests. These storage compartments vary in size with one of them also being configured to support and insulate a beverage container therein. A towel rack also forms a part of the foldable frame for supporting and drying a towel. A removable handle is secured to the frame for moving or transporting the chair as desired. Additionally, a strap securing adjacent storage compartments together also retains the chair in its folded state.

18 Claims, 11 Drawing Sheets

CARRY-ALL CHAIR

BACKGROUND OF THE INVENTION

1. Field of the Invention

This invention pertains to a folding chair in general, and more particularly, to a beach chair that incorporates multiple storage facilities, pivotable canopy and towel rack and which is easily folded and transported.

2. General Background

As is well known, there are many varieties of folding beach chairs available to the user. A rather current version is illustrated in U.S. Pat. No. 5,139,308 issued to Ziman. This folding beach chair incorporates a single storage bag secured to its back rest and a pair of back-pack straps for transporting the chair on the user's back.

Another variation of back-pack style chairs is disclosed in U.S. Pat. No. 4,487,345 issued to Peirce, et al. This patent illustrates a reclining chair that can be carried back-pack style and which also incorporates a single storage compartment secured to its back rest. U.S. Pat. No. 4,676,548 issued to Bradbury also discloses a back-pack style folding chair having multiple storage compartments secured to its back rest.

U.S. Pat. No. 2,926,724 issued to Rittenberg discloses a different version of folding chairs from that described above. This patent illustrates a reclining chair having no storage compartments but instead incorporating a pivotable overhead canopy. U.S. Pat. No. 2,747,653 issued to Obradovich also discloses a reclining chair having no storage compartments but having a horizontally maintained adjustable canopy instead. U.S. Pat. No. 2,505,702 issued to Benjamin also discloses a reclining chair having an overhead canopy but with no storage compartments secured thereto. U.S. Pat. No. 2,840,142 discloses a portable cart that can be re-configured to be laid out flat upon the ground into the shape of a reclining lounge which also incorporates an overhead canopy and a single storage compartment secured to its back rest.

While each of these devices may be suitable for their intended purpose, none of them satisfy many of the needs desired by the user while at the beach. For example, the user desires many storage compartments for carrying/holding such items as magazines, lotion, hats, sunglasses, beach toys and games, etc. It is also desirable for these storage compartments to be removable should they not be required. Furthermore, it is preferable for there to be separate insulated storage compartments for cold drinks or food and the like which can be removed and replaced as needed. It is also desirable for the chair to be easily foldable and portable and to include a canopy to protect the user from the sun or rain. Still another desirable feature is for the chair to incorporate a towel rack so that the user can dry one or more towels without resorting to laying them upon the sand or otherwise interfering with the operation and use of the chair.

It is thus an object of the present invention to provide a folding beach chair that incorporates all of the desirable features described above. Such a beach chair not only folds and can be strapped so as to remain folded, but a further purpose of this invention is to include a carrying handle that can be snapped on and off as required. Yet another object of this invention is to provide removable storage compartments that can be secured to the arms and back of the chair thereby increasing the storage capacity of the chair. Yet another object of this invention is to provide a beach chair that also reclines. These and other objects and advantages of this invention will become obvious upon further investigation.

SUMMARY OF THE PRESENT INVENTION

The preferred embodiment of the apparatus of the present invention solves the aforementioned problems in a straightforward and simple manner. This invention pertains to a reclining chair that incorporates a foldable frame supporting a pair of pivotable arm rests therefrom. A fabric material extends across certain portions of this foldable frame so as to provide support to the user. Above this frame, yet secured thereto, is a canopy for shielding the chair and also the user. Multiple storage compartments are secured to the frame and to the arm rests for holding a variety of items therein. This frame is retained in the folded position by a strapping assembly and is carried by means of a removable handle which is also secured to the frame. A towel rack is incorporated into the chair as part of the foldable frame.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
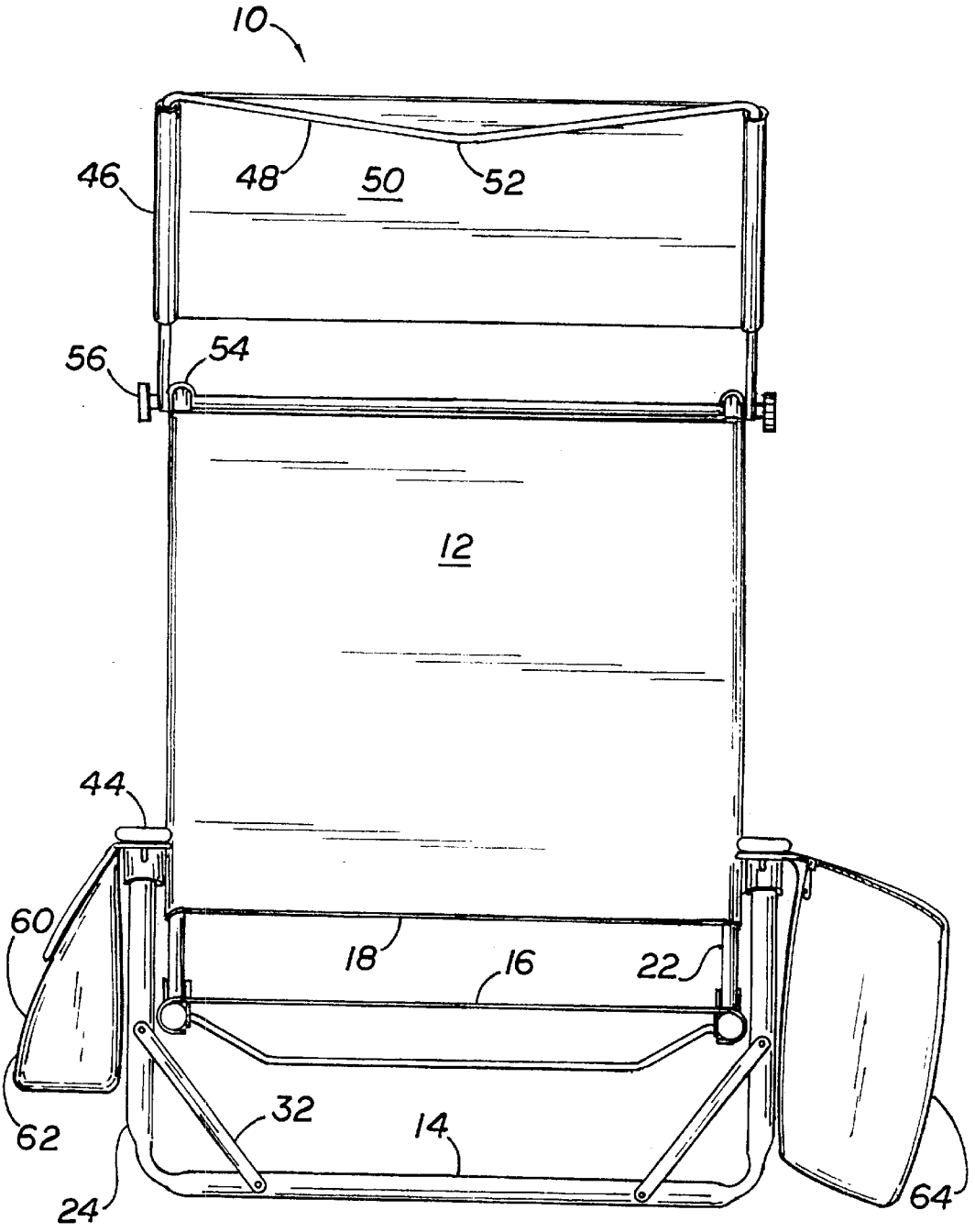
FIG. 1 is a front view of the invention in its unfolded state.
Figure 2:
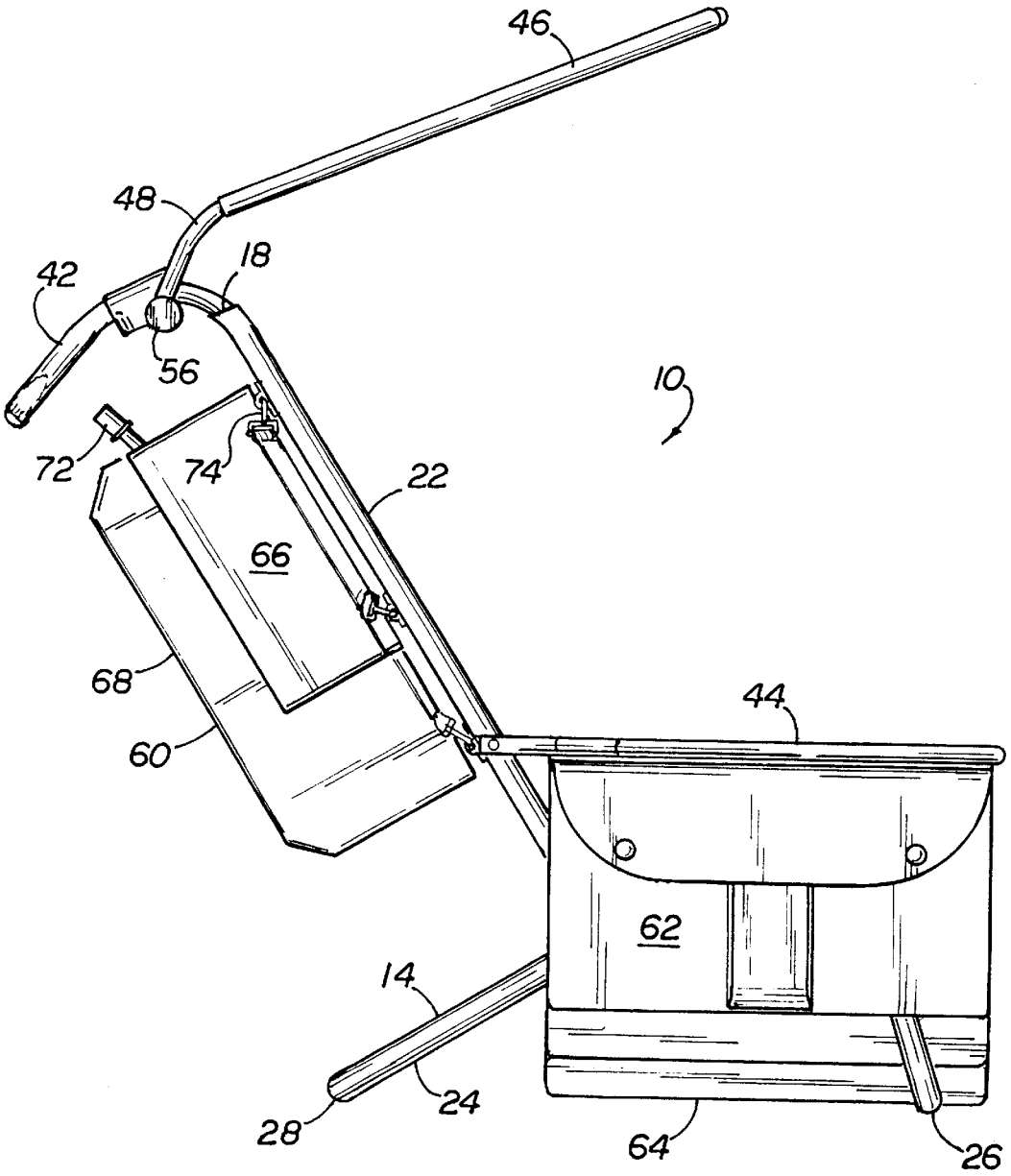
FIG. 2 is a right side view of the invention in its unfolded state.
Figure 3:
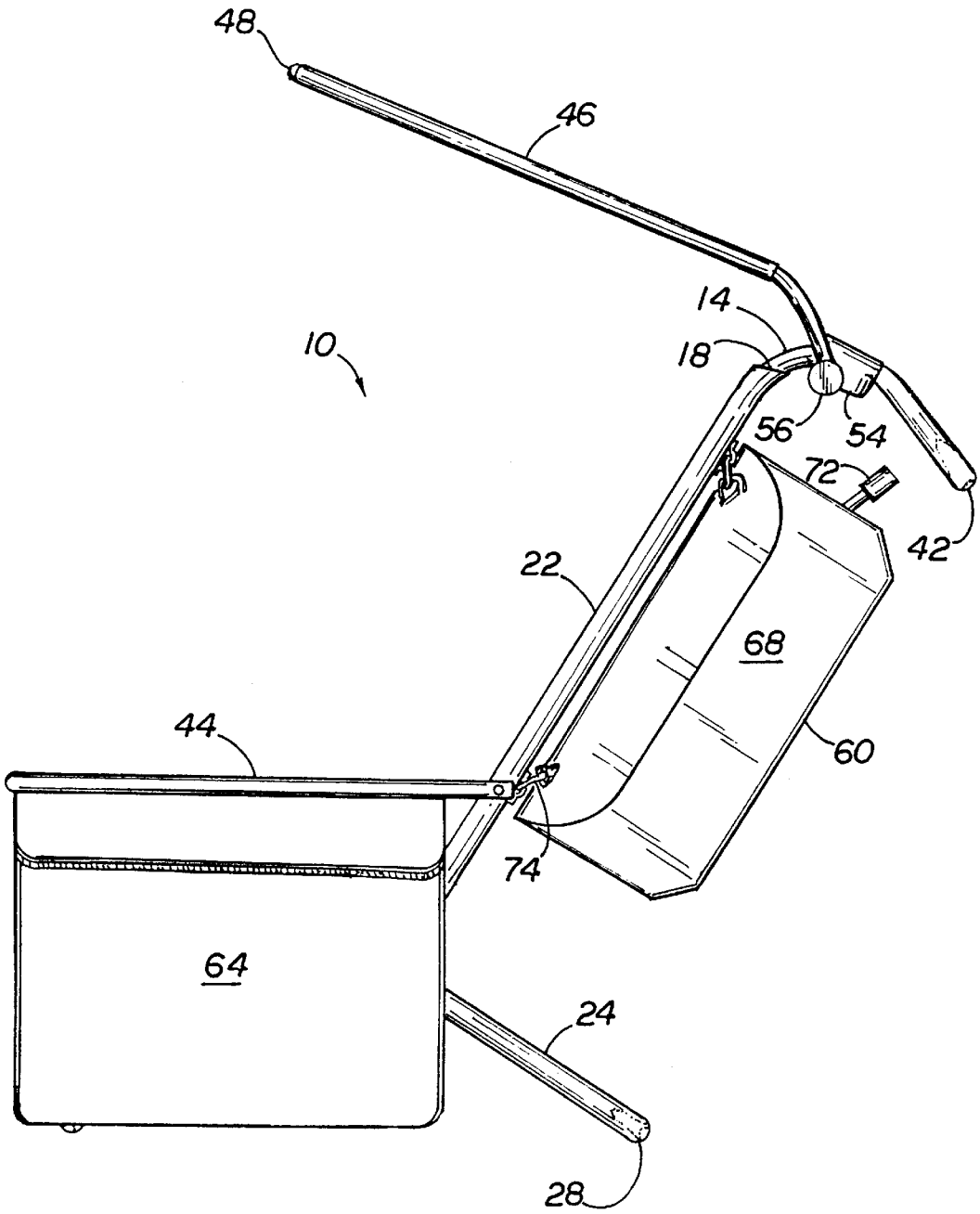
FIG. 3 is a left side view of the invention in its unfolded state.
Figure 4:
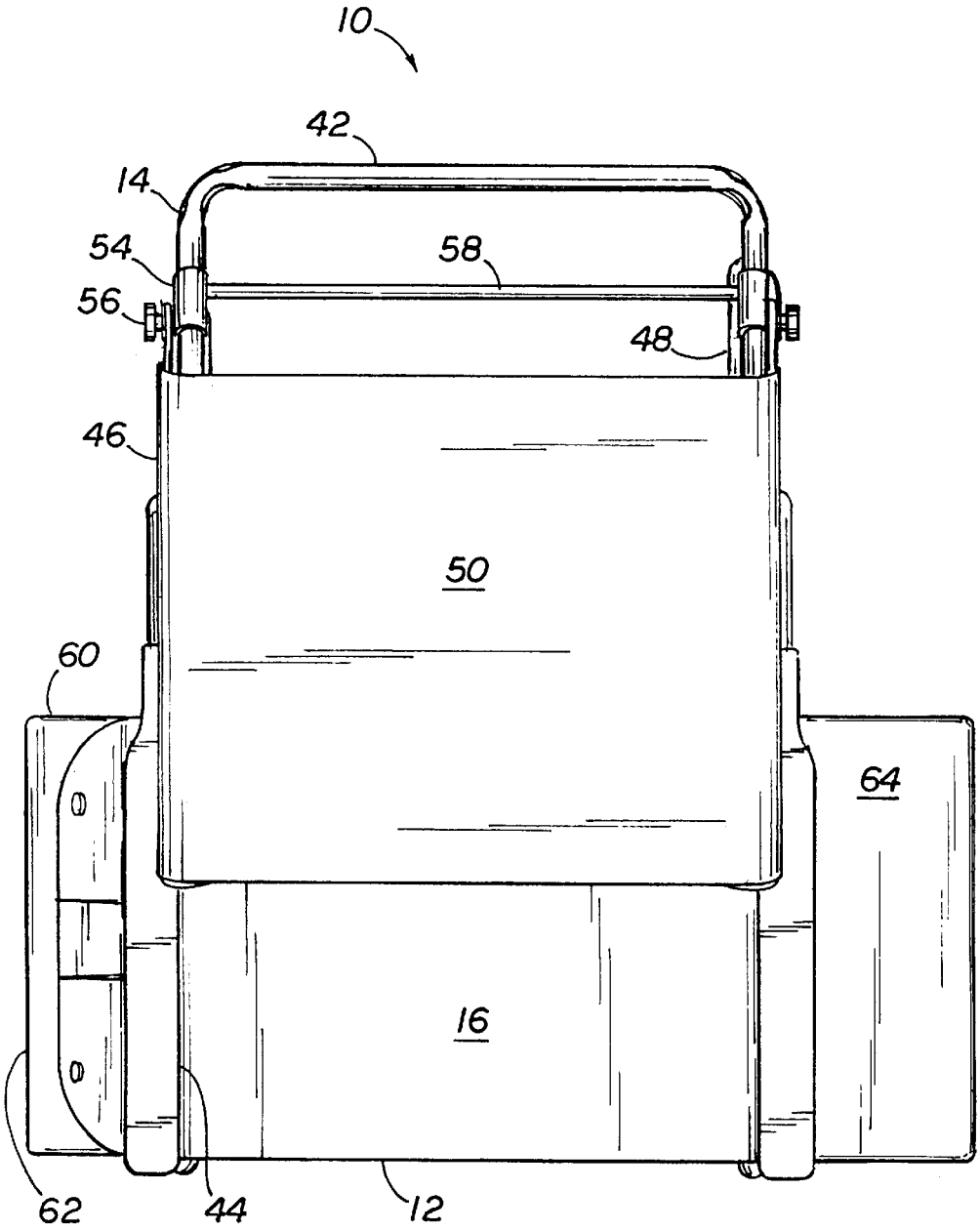
FIG. 4 is a top view of the invention in its unfolded state.
Figure 5:
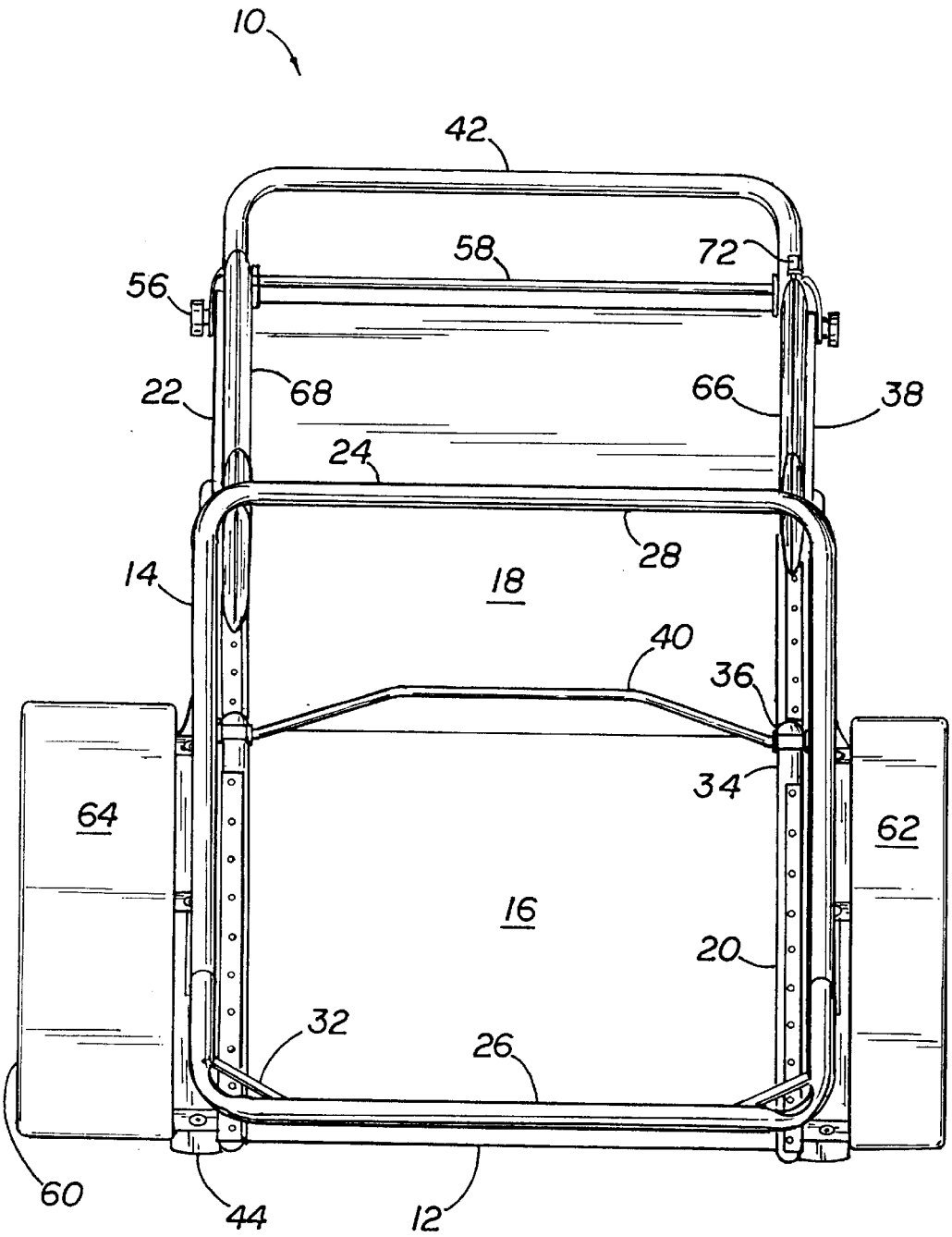
FIG. 5 is a bottom view of the invention in its unfolded state.
Figure 6:
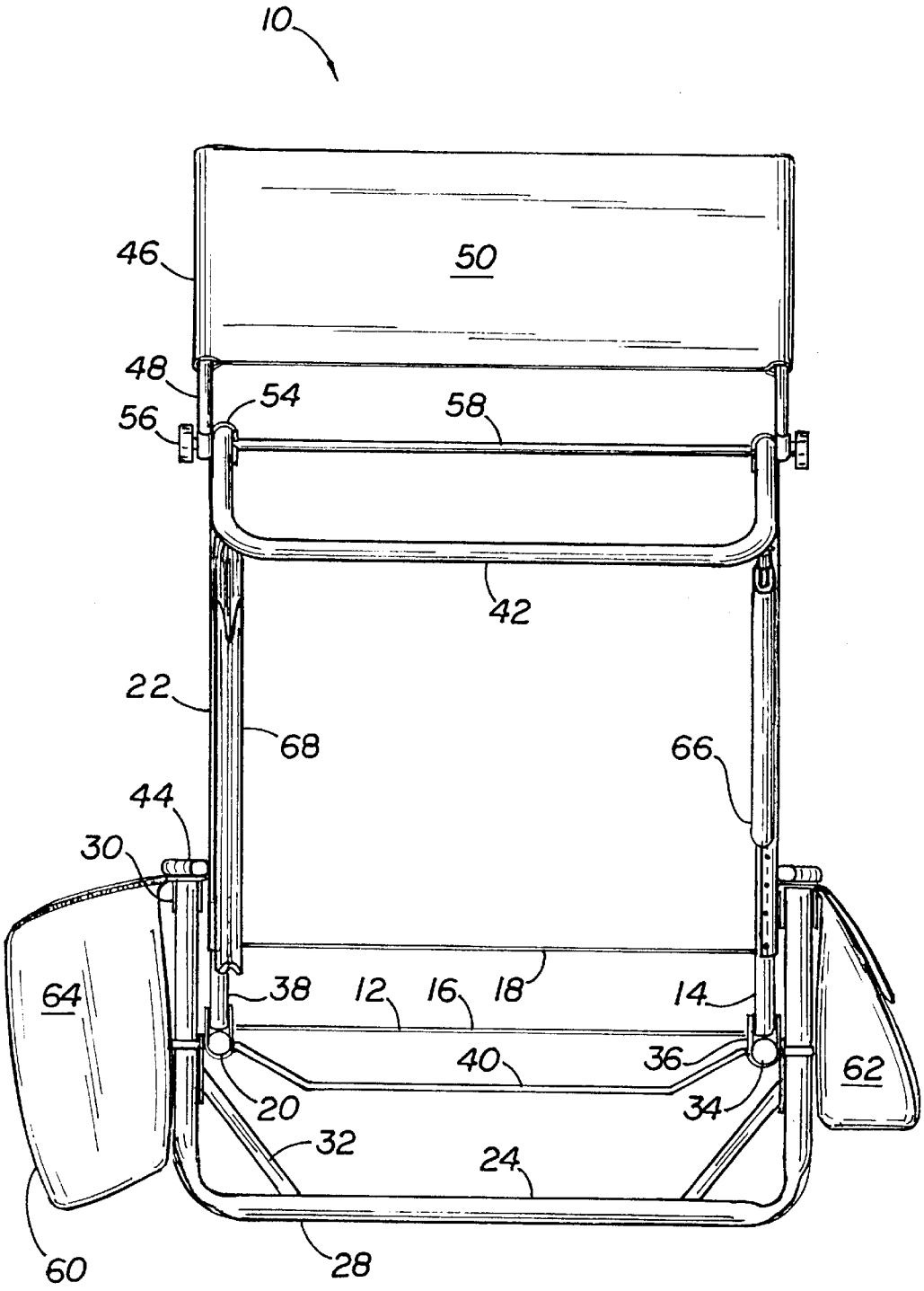
FIG. 6 is a rear view of the invention in its unfolded state.

Referring to the drawing, and particularly FIGS. 1–7, there is shown beach chair 10 having a webbing or fabric 12 supported from frame 14. Fabric 12 is preferably constructed of a nylon material due to its strength and durability, but any other type of man-made or natural fabric material may also suffice as well as a blend of the two such as a cotton/polyester blend. The important feature of fabric 12 is to be strong and flexible enough to support the weight of the user without tearing even when wet or exposed to the elements for long periods of time. It is also desirable for fabric 12 to dry quickly, such as by having an open weave, and to be resistant to rot or decay during storage, even if stored damp or under wet conditions.

Fabric 12 will generally consist of seat 16 and back 18 portions, both of which will be suspended, secured or strung across open areas of frame 14. Seat 16 and back 18 can incorporate a variety of designs therein and can also be made to be easily replaceable should wear or other damage occur thereto. It is also desirable for each seat 16 and back 18 to be sized so as to provide both comfort and support to the user when chair 10 is deployed.

In this embodiment, the various members of frame 14 are shown as being constructed of bent aluminum tubes. However, any other material can also suffice, such as coated or galvanized steel or even a strong plastic, which may also be non-circular if such is desired. Furthermore, frame 14 consists of a variety of different sub-frame support assemblies that are either pivotally or fixedly secured to each other. These sub-frame assemblies include seat support assembly 20, back support assembly 22, and leg assembly 24.

Figure 7:
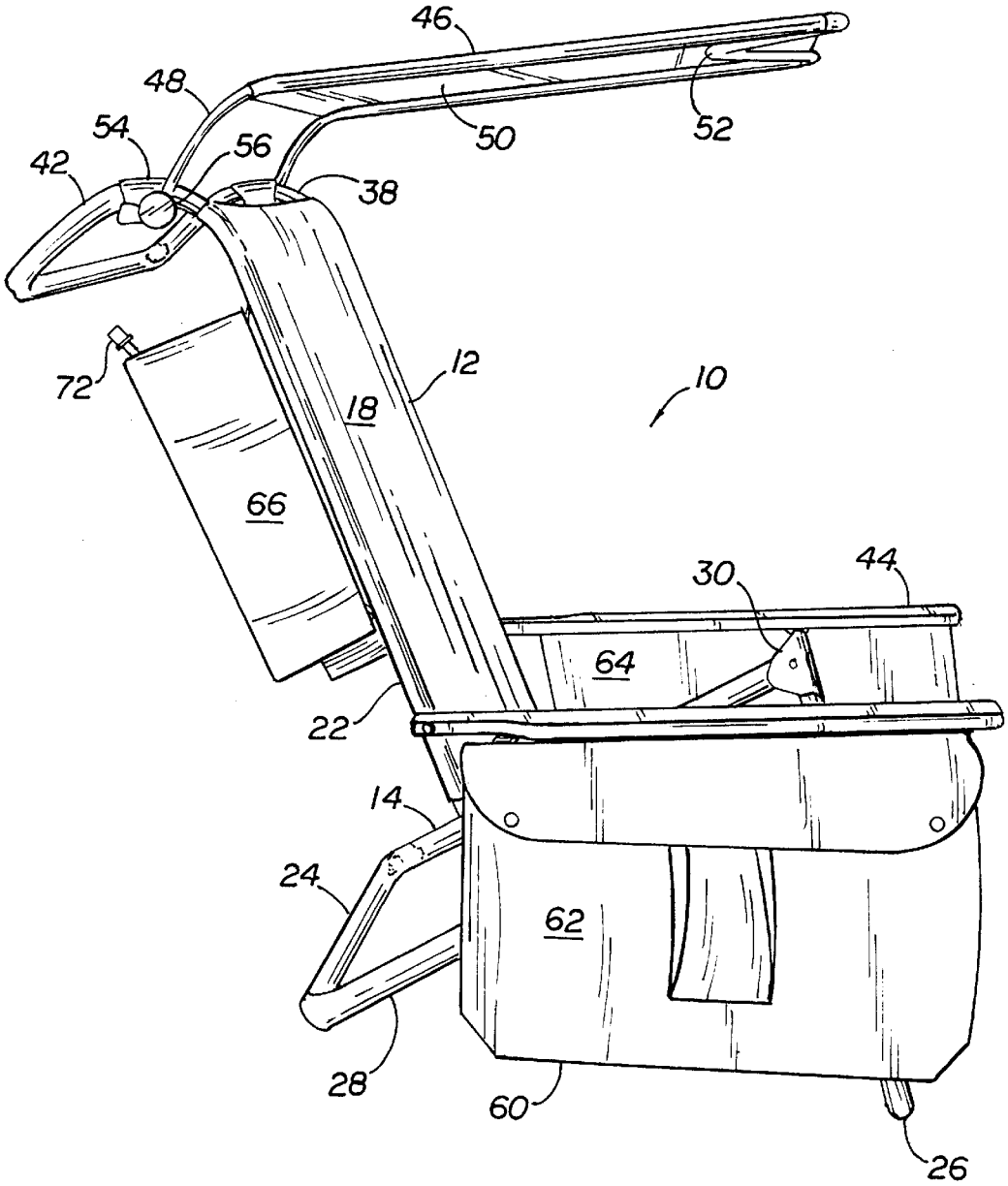
FIG. 7 is a front right perspective view of the invention in its unfolded state.
Figure 8:
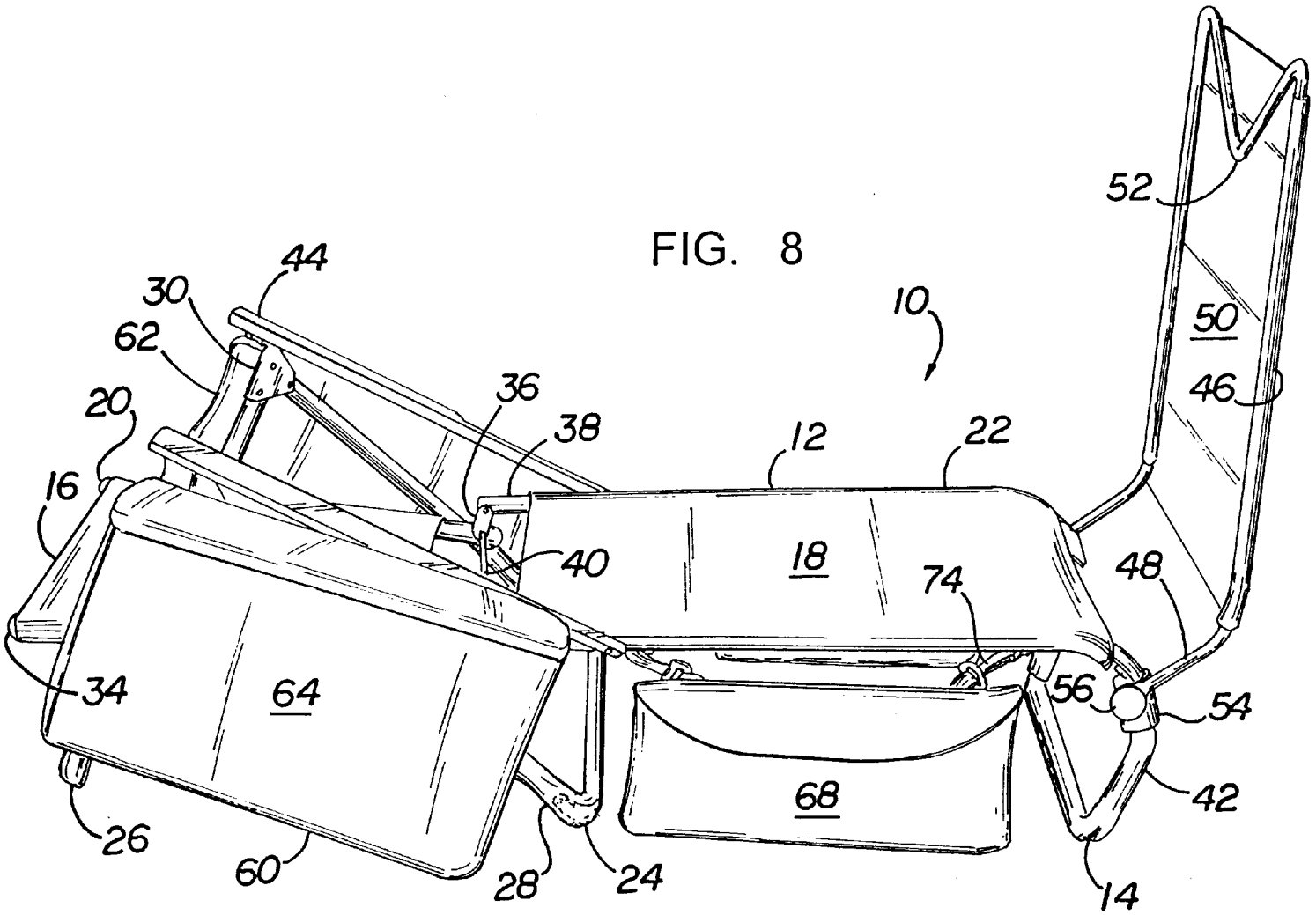
FIG. 8 is a left perspective view of the invention in its reclined state.
Figure 9:
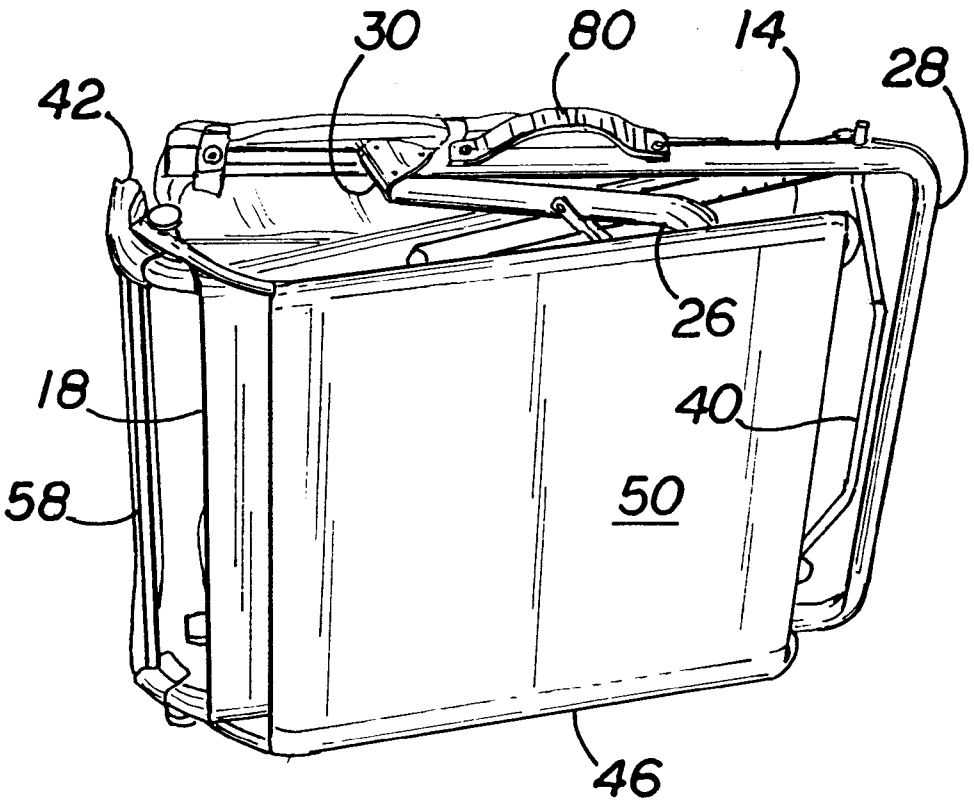
FIG. 9 is a perspective view of the invention in its folded state.

In accordance with this embodiment, leg assembly 24 consists of front and back "U" shaped members 26 and 28 that are pivotally secured together at bracket 30. Other configurations of members 26 and 28 are also likely, they need not be "U" shaped as described herein so long as such members provide support to and act as the legs of chair 10. In this embodiment, however, both end regions of both members 26 and 28 meet at bracket 30. If desired, these "U" shaped members 26 and 28 may be strengthened by one or more braces 32 across their bends as shown. As best seen in FIGS. 7–9, members 26 and 28 are pivoted open or apart from each other during use and are pivoted together during storage of chair 10.

Seat support assembly 20, in accordance with this embodiment, consists of a generally horizontally disposed "U" shaped member 34 that is pivotally secured to each of members 26 and 28 of leg assembly 24. Typically, member 34 is secured to members 26 and 28 via pins or the like. Of course, other means of forming seat support assembly 20 or of pivotally securing seat support assembly 20 to leg assembly 24 are possible, the version illustrated herein being for descriptive purposes only. As shown, seat 16 of fabric or webbing 12 is strung or suspended across the open area of this "U" shaped member 34. Both end regions of member 34 are pivotally secured to bracket 36 near the back of chair 10. In this fashion, seat support assembly 20 can be pivoted as needed for the folding or unfolding of chair 10.

Back support assembly 22 also generally consists of a single "U" shaped member 38 that also has its end regions pivotally secured to bracket 36. In this fashion, back support assembly 22 can be pivoted with respect to generally horizontally disposed seat support assembly 20 and also with respect to leg assembly 24. For support purposes and also to increase the strength of chair 10, a brace 40 will generally extend between oppositely located brackets 36. As shown, back 18 of fabric or webbing 12 is strung or suspended across the open area of this "U" shaped member 38. However, as illustrated, the upper or closed region of "U" shaped member 38 is configured non-planer in that this upper region is bent generally orthogonal to the plane of the remainder of member 38 and/or to the plane of back 18. Such a non-planer bend to member 38 of back support assembly 22 enables this member 38 to form a towel rack 42 for the drying of towels. Bent towel rack 42 also acts as a stop and as a further means of support when back support assembly 22 is reclined flat, i.e. pivoted to a generally horizontal position which is oftentimes co-planar with seat support assembly 20 (see FIG. 8). Of course, back 18 of fabric or webbing 12 will not extend across towel rack 42.

Figure 11:
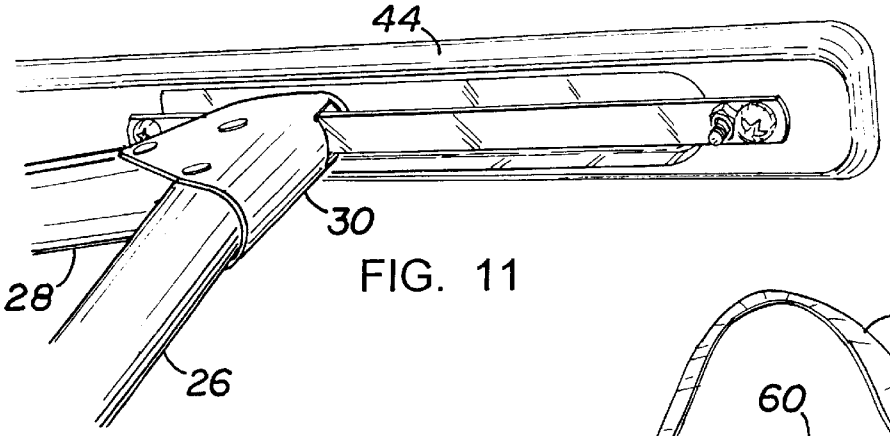
FIG. 11 is an enlarged view of one of the underside of the arm rests.

Pivotally secured to opposite sides of member 38 of back support assembly 22 are arm rests 44. These arm rests 44 extend and generally remain extended somewhat parallel to member 34 of seat support assembly 20 regardless of the inclination of back support assembly 22. Of course, as back support assembly 22 is reclined further and further, the angle arm rests 44 make with respect to seat support assembly 20 may also vary. While one end of each arm rest 44 is pivotally secured to back support assembly 22 via a pin or the like, the opposite end of each arm rest 44 is supported adjacent (and generally atop) bracket 30. This manner of securement to bracket 30 is not fixed but instead may vary so as to permit back support assembly 22 to pivot or recline with respect to seat support assembly 20. Generally, such a manner of securement involves a slotted plate affixed to each arm rest 44 with this slotted plate incorporating different stops depending upon the degree of decline desired. Other versions of this manner of securement may involve a series of notches in the underneath side of each arm rest 44 into which an end region of, say, front "U" shaped member 26 of leg assembly 24 is fitted (see FIG. 11). In this manner, member 26 may be inserted into a different notch in the underneath side of arm rest 44 if a different angle of incline of back support assembly 22 is desired. Other versions of adjustably supporting the cantilevered end of arm rests 44 are also likely that will also permit back support assembly 22 to pivot or recline as needed.

Secured to towel rack 42, or at least to the top of member 38 of back support assembly 22, is canopy 46. Canopy 46 is preferably made from ultra-violet, beta tan-through materials and is cantilevered outwardly from member 38 and extends over and generally parallel to seat support assembly 20. In this fashion, canopy 46 will be in a position to provide shade and other protection (e.g. rain) for the user of chair 10. Canopy 46 also comprises a "U" shaped member 48 having a covering of fabric or webbing 50 extending across its open area. As shown in the drawing, the cantilevered end of member 48 is not a true "U" shape in that it is bent 52 so as to prevent covering 50 from sagging during use. Also, where member 48 is supported from back support assembly 22 is also curved or bent so as to provide clearance for the head of the user. The opposite ends of member 48 are each separately and pivotally secured to back support assembly 22 via connector 54 so as to permit canopy 46 to be pivoted as needed. Once the desired location or position of canopy 46 is achieved, knob 56 of each connector 54 (or some other such means) is tightened to retain canopy 46 in this position. It may also be possible to slide connector 56 along towel rack 42 thereby enhancing the adjustability of canopy 46 with respect to chair 10. Brace 58 is also generally incorporated between connectors 54 so as to provide stability and support.

Figure 14:
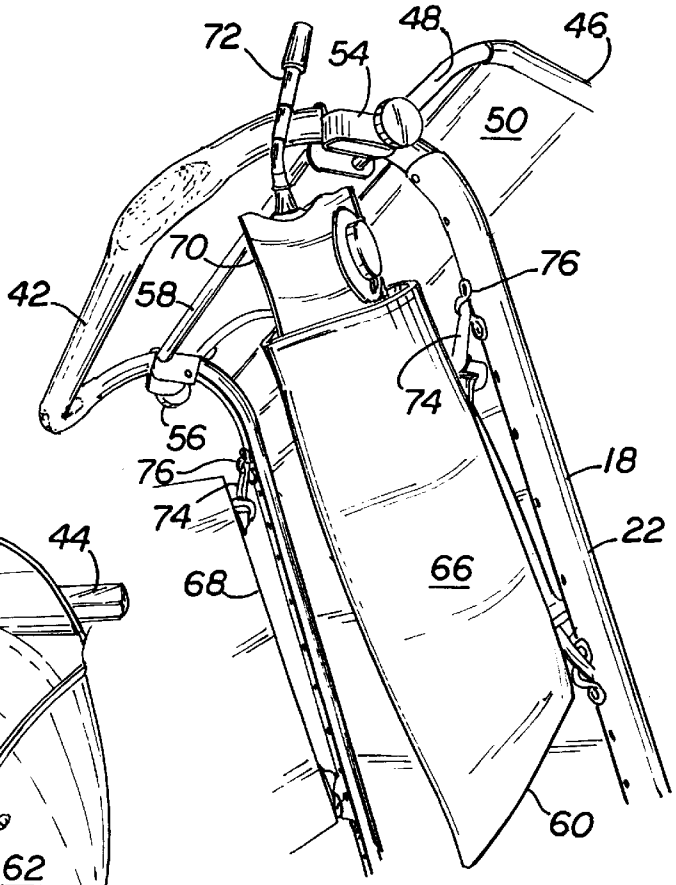
FIG. 14 is an enlarged view of the insulated storage compartments illustrating its beverage container partially removed; and, FIG. 15 is an enlarged view of one of the storage compartments in its open state.

As shown in the drawings, chair 10 supports a series of accessory storage compartments 60. In this embodiment, chair 10 incorporates first and second compartments 62 and 64 which are suspended underneath arm rests 44 and also third and fourth compartments 66 and 68 which are suspended from member 38 of back support assembly 22. Generally, two of these storage compartments 64, 66 are also insulated and lined so as to keep previously cooled foods and/or beverages in a cold condition (of course, ice may be added to improve the conditions). These insulated storage compartments 64, 66 would also need to be watertight so as not to leak. Additionally, it is preferable for one storage compartment, here illustrated as third compartment 66, to be configured to hold a removable beverage container 70 having mouthpiece 72 (see FIG. 14). Such third compartment 66 would also generally be insulated so as to keep beverage container 70 at a chilled or cold temperature.

Figure 12:
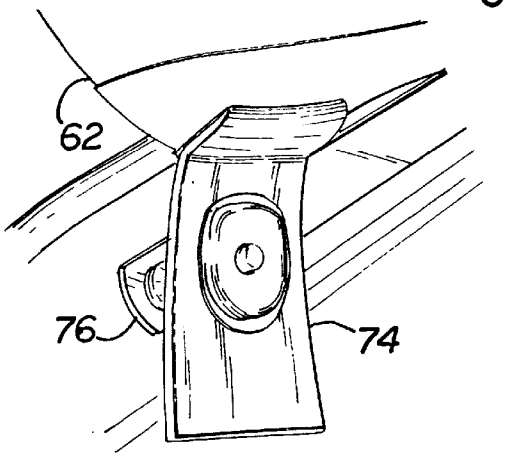
FIG. 12 is a perspective view of one means of securing the storage compartments to the chair.
Figure 15:
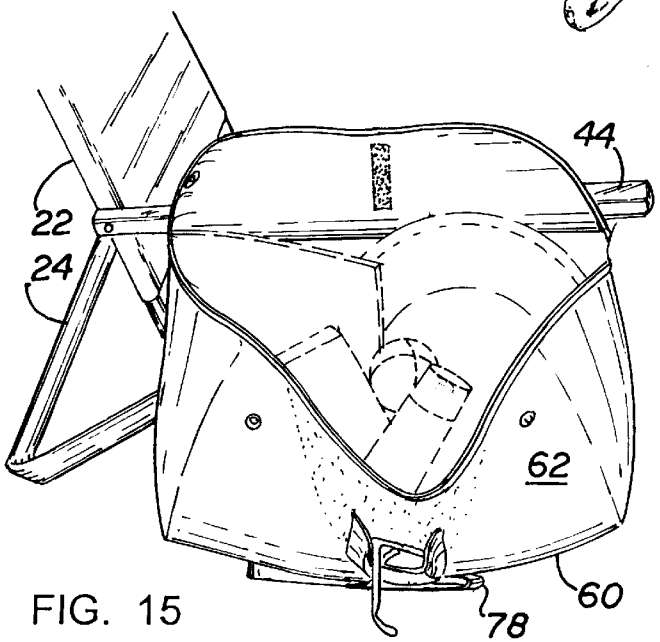

The sizes of each of these compartments 60 may vary as needed so that one compartment 60 may be sized to hold magazines and other reading material while another may be sized to hold sunglasses, lotion, toys, etc. (see FIG. 15). Additionally, compartments 60 are configured to be easily movable from one side of chair 10 to the other as well as from underneath arm rest 44 to back support assembly 22 and vice versa as desired. Such compartments 60 may be held closed via a hook and loop securement system, zippers, snaps, clasps, buttons or any other manner (see FIG. 12). While the drawings indicate that the compartments 60 are secured to chair 10 via a plurality of hooks 74 passing through eyelets 76, other means of removably attaching compartments 60 to chair 10 are also likely, such as through snaps, clasps, buttons or the like. Additionally, each compartment 60 itself may be configured with multiple pockets or compartments therein or additional pockets secured to its exterior shell. Storage compartments 60 are generally constructed of a nylon or other man-made material, but they can also be made of a natural material such as cotton canvas, or a blend of the two.

Figure 10:
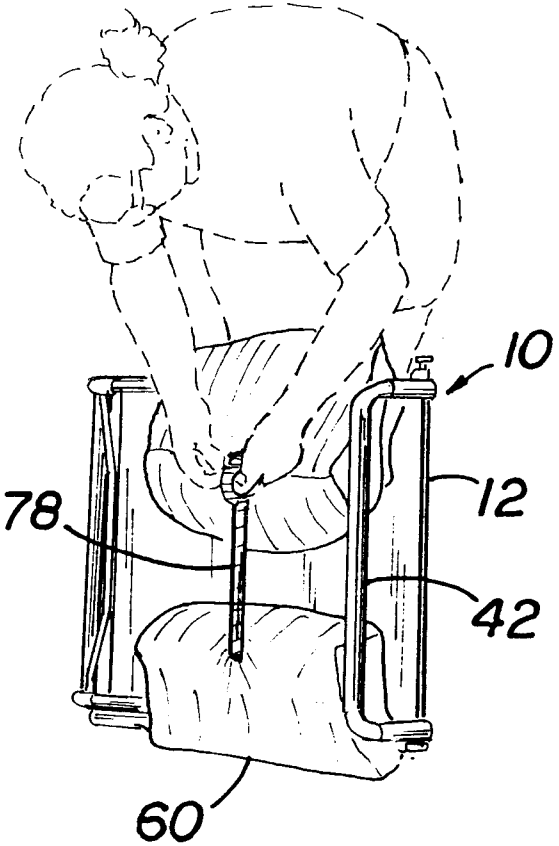
FIG. 10 is another perspective view of the invention in its folded state.

Consequently, when a user of chair 10 desires a drink or a book to read or sunglasses, such user need only open the near-by compartment 60 containing such item. Also, should the user desire shade or protection from the elements, he/she need merely operate knobs 56 so as to move canopy 46 to the desired position. Also, if a different inclination of back support assembly 22 is desired, the user need only make the necessary adjustments to arm rests 44 so that back support assembly 22 can then be raised or lowered as desired.

when chair 10 is no longer to be utilized, it is a simple matter to fold chair into a more compact state for subsequent transportation and storage (see FIG. 9). Generally, when folding chair 10, the various storage compartments 60 would simply be emptied of their contents and then compressed to facilitate such folding. Also, as indicated in FIG. 10, the closure strap 78 of one storage compartment 60 may be secured to an opposite storage compartment 60 thereby retaining both such storage compartments 60 in place during transport. Furthermore, chair 10 can be folded such that a pair of storage compartments 60 are pivoted over the outside of frame 14 before being secured together by strap 78 thereby restraining chair 10 in this folded state. Alternatively, such storage compartments 60 can be removed prior to folding if that is desired. A much longer strap can also be used to secure chair 10 in the folded position. This longer strap would generally be strung fully around chair 10 thereby restraining chair 10 and its accessory storage compartments 60 in place.

Figure 13:
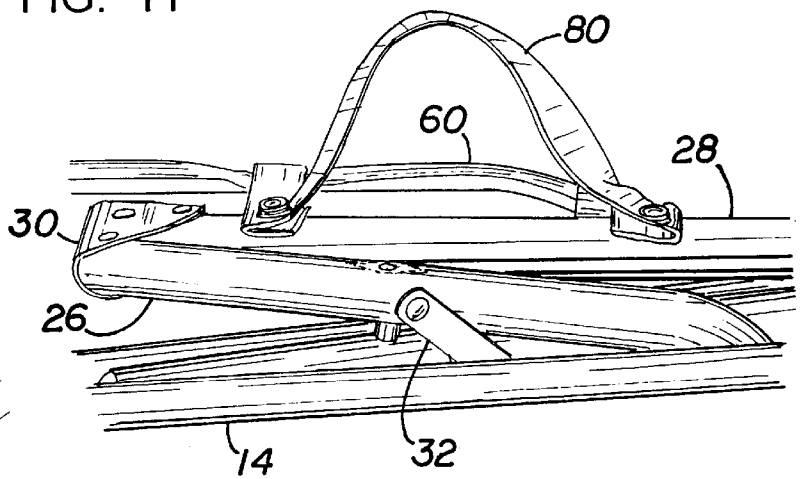
FIG. 13 is an enlarged view of the carrying handle of the invention.

FIG. 13 illustrates a removable nylon handle 80 that is snapped or otherwise secured to a section of frame 14 for ease in moving and handling chair 10. This handle 80, along with the longer strap referred to above, can be stored, when not in use, in one of storage compartments 60. Handle 80 would generally be configured with buttons or snaps at its ends that would mate with corresponding components secured to frame 14.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A reclining chair comprising:

(a) a foldable frame having open areas therein and supporting a pair of pivotable arm rests therefrom;

(b) fabric means for extending across said open areas of said foldable frame;

(c) a canopy having a member with ends pivotally secured to said foldable frame through a connector for moving said canopy outwardly from said foldable frame so that said canopy is generally parallel to a seat portion of said foldable frame for shielding the chair;

(d) multiple storage unit compartments, at least one of said storage compartments being secured to said foldable frame and another of said storage compartments being secured to one of said arm rests;

(e) strapping means for retaining said frame in a folded position;

(f) handle means secured to said foldable frame for transporting the chair; and (g) a towel rack coupled to said foldable frame.

2. The reclining chair as set forth in claim 1, further comprising means for selectively providing multiple reclining positions.

3. The reclining chair as set forth in claim 2, wherein said foldable frame comprises a seat support assembly, a back support assembly, and a leg assembly.

4. The reclining chair as set forth in claim 3, wherein said fabric means extend across said seat support assembly and said back support assembly.

5. The reclining chair as set forth in claim 4, wherein said canopy means are secured to said back support assembly.

6. The reclining chair as set forth in claim 5, wherein said canopy means are made of an ultra-violet beta tan-through material and adjustable with respect to said back support assembly.

7. The reclining chair as set forth in claim 6, further comprising:

removably attaching means for securing said storage compartment to said foldable frame and for securing said another of said storage compartments to said arm rest so that said another of said storage compartments is suspended from said one arm rest.

8. The reclining chair as set forth in claim 7, wherein said storage compartments are secured to said back support assembly of said foldable frame.

9. The reclining chair as set forth in claim 8, wherein said storage compartments are of different sizes.

10. The reclining chair as set forth in claim 9, wherein at least one said storage compartment is insulated.

11. The reclining chair as set forth in claim 10, wherein at least one said storage compartment encloses a removable beverage container.

12. The reclining chair as set forth in claim 11, wherein said handle means are removably secured to said frame.

13. The reclining chair as set forth in claim 12, wherein said towel rack forms a part of said back support assembly.

14. A reclining chair comprising:

(a) a foldable frame having open areas therein and supporting a pair of pivotable arm rests therefrom said frame comprising: a seat support assembly, a back support assembly, and a leg assembly;

(b) fabric means for extending across said open areas of said foldable frame;

(c) a canopy having a member with ends pivotally secured to said foldable frame through a connector for moving said canopy outwardly from said foldable frame so that said canopy is generally parallel to a seat portion of said foldable frame for shielding the chair;

(d) multiple storage compartments, at least one of said storage compartments being secured to said foldable frame and another of said storage compartments being secured to one of said arm rests;

(e) strapping means for retaining said frame in a folded position;

(f) handle means secured to said foldable frame for transporting the chair;

(g) a towel rack coupled to said foldable frame; and (h) means for selectively providing multiple reclining positions.

15. The reclining chair as set forth in claim 14, wherein said fabric means extend across said seat support assembly and said back support assembly.

16. The reclining chair as set forth in claim 15, wherein said canopy means are made of an ultra-violet beta tan-through material and adjustable with respect to said back support assembly.

17. The reclining chair as set forth in claim 16, further comprising:

removably attaching means for securing said storage compartment to said foldable frame and for securing said another of said storage compartments to said arm rest so that said another of said storage compartments is suspended from said one arm rest.

18. The reclining chair as set forth in claim 17, wherein said storage compartments are secured to said back support assembly of said foldable frame.

* * * * *